US005792484A

United States Patent [19]

Schmidgall

[11] Patent Number: 5,792,484

[45] Date of Patent: Aug. 11, 1998

[54] AUTOMATED FEED SYSTEM FOR PIPE MAKING MACHINE

[75] Inventor: Ronald D. Schmidgall, Mediapolis, Iowa

[73] Assignee: Hawkeye Concrete Products Co., Mediapolis, Iowa

[21] Appl. No.: 802,121

[22] Filed: Feb. 19, 1997

[51] Int. Cl.[6] ..... B28B 21/02; B28B 13/02

[52] U.S. Cl. ..... 425/145; 425/258; 425/447; 425/449

[58] Field of Search ..... 425/145, 135, 425/150, 453, 447, 449, 258

[56] References Cited

U.S. PATENT DOCUMENTS

| | | | |
|---|---|---|---|
| 1,075,936 | 10/1913 | Pelke et al. . | |
| 2,356,852 | 8/1944 | Hutchinson . | |
| 3,465,394 | 9/1969 | Bergesen et al. | 425/449 |
| 3,696,182 | 10/1972 | Joelson . | |
| 3,901,642 | 8/1975 | Urmanov et al. . | |
| 4,118,165 | 10/1978 | Christian . | |
| 4,226,568 | 10/1980 | Christian . | |
| 4,248,580 | 2/1981 | Christian . | |
| 4,336,013 | 6/1982 | Hand | 425/145 |
| 4,340,553 | 7/1982 | Fosse | 425/145 |
| 4,360,331 | 11/1982 | Hiraoka | 425/145 |
| 4,406,605 | 9/1983 | Hand | 425/145 |
| 4,407,648 | 10/1983 | Fosse . | |
| 4,588,544 | 5/1986 | Kraiss . | |
| 4,708,621 | 11/1987 | Schmidgall et al. . | |
| 4,957,424 | 9/1990 | Mitchell et al. | 425/145 |
| 5,147,196 | 9/1992 | Adly | 425/145 |
| 5,234,331 | 8/1993 | Schmidgall | 425/259 |
| 5,248,248 | 9/1993 | Adly | 425/145 |

OTHER PUBLICATIONS

Page from TEKSAM brochure for TEKSAM Vibration System.

Page from brochure for Vibro–Mac.

Page from Pedershaab Inc. brochure for VIHY Simplex Double station Combi Program.

Page from Colle brochure for Hopper/Belt Conveyor Assembly.

*Primary Examiner*—Khanh P. Nguyen

*Attorney, Agent, or Firm*—James C. Nemmers

[57] ABSTRACT

An automated feeder for concrete pipe making machines used to produce concrete pipes that have round as well as box-shaped, elliptical and other non-round shapes. The feeder has a concrete storage hopper mounted over a fixed pivot, and the hopper charges the concrete onto a belt-type conveyor the input end of which turns on the same pivot as the hopper for movement along a radial track. The discharge end of the feeder conveyor discharges the concrete into a rotatable chute that distributes the concrete into the cavity of the pipe mold. Encoders are combined with the motors driving the chute and the radial movement of the feeder conveyor so as to monitor the position and speed of the radial movement of the conveyor and position and speed of rotation of the chute. Information from the encoders is inputted into a computer which is programmed to control the speed and position of these components of the feeder depending upon the selected size and shape of the concrete form to be filled.

7 Claims, 7 Drawing Sheets

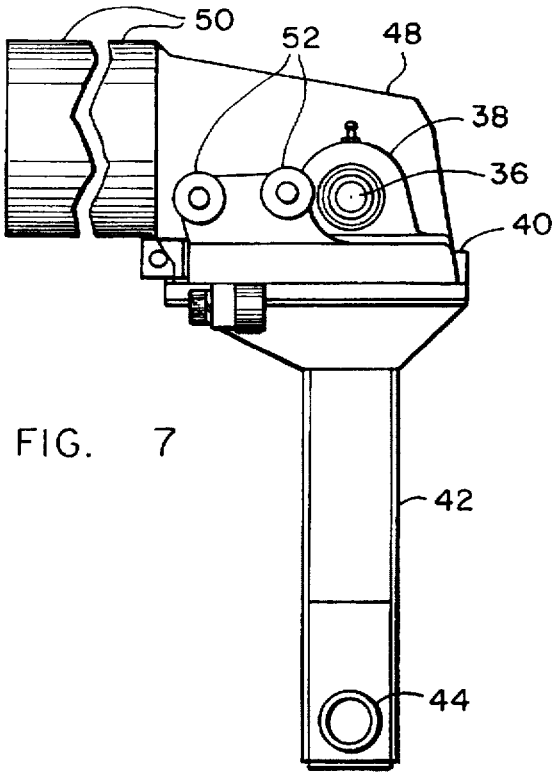
FIG. 7
FIG. 6
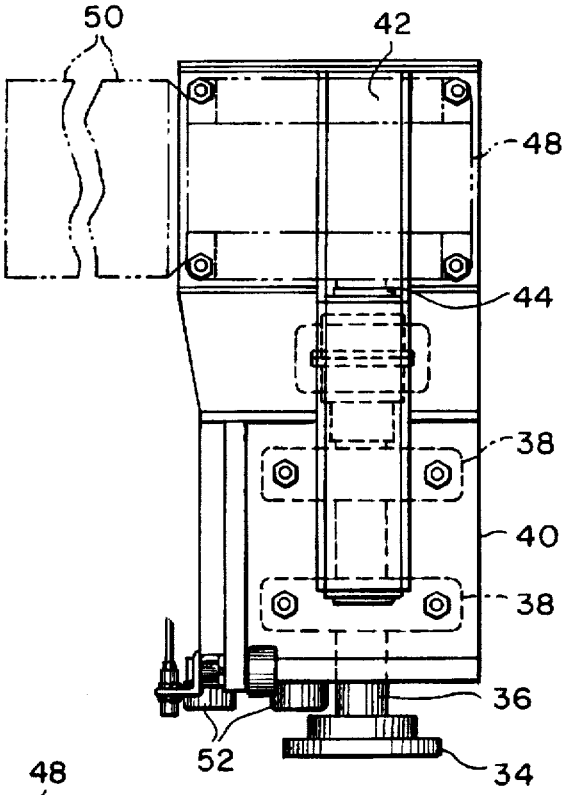
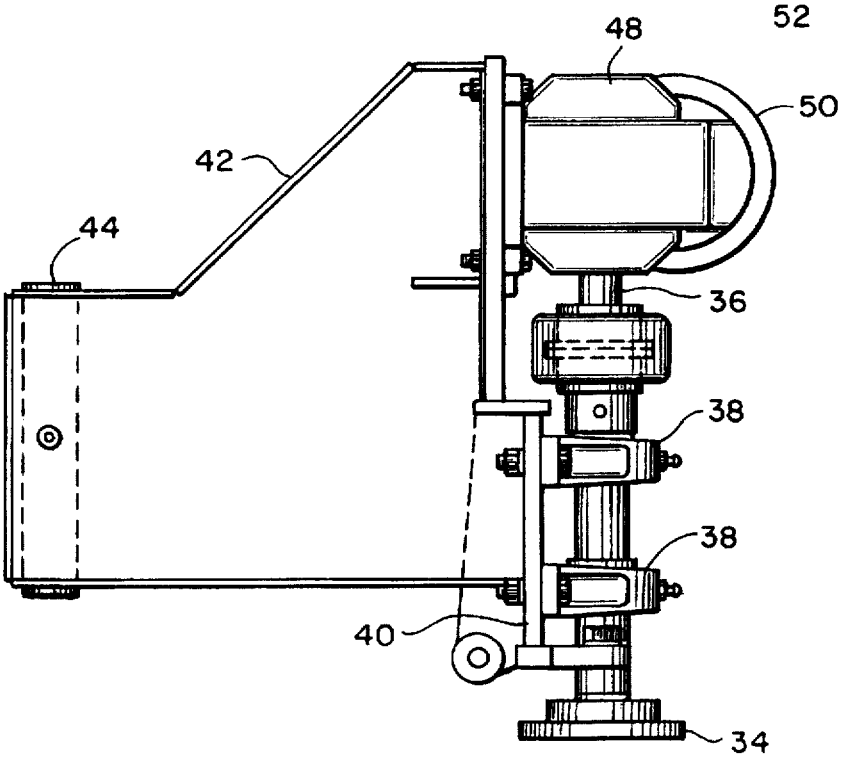
FIG. 8

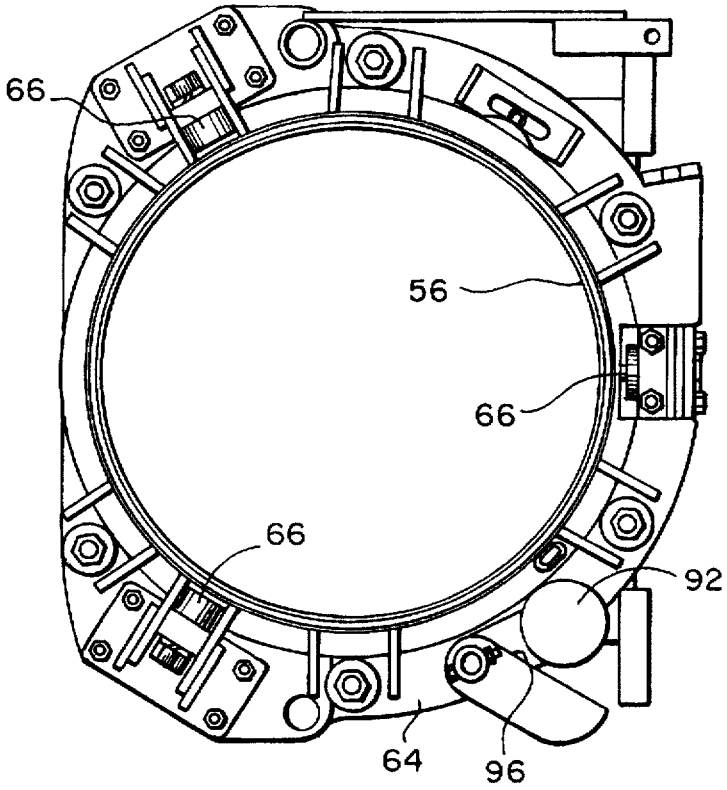
FIG. 12
FIG. 13
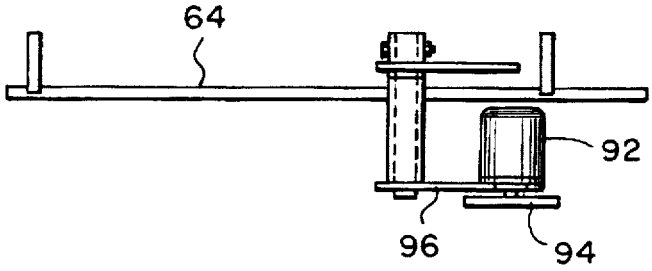
FIG. 14
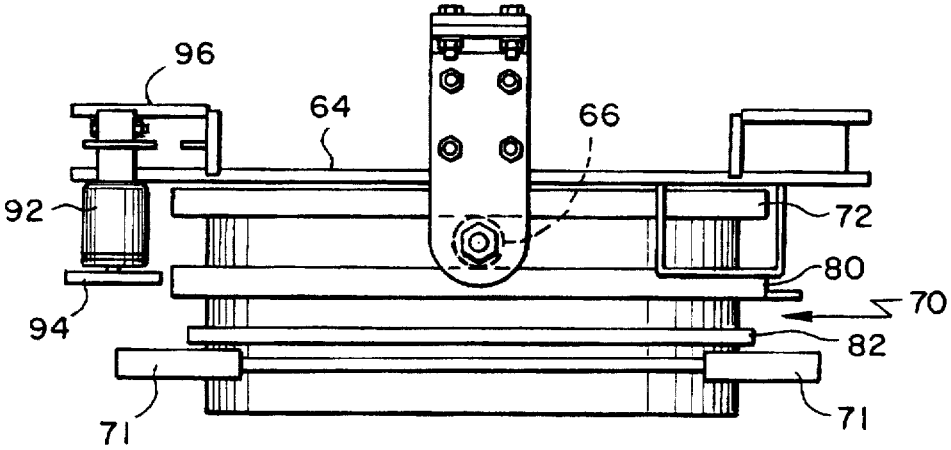

AUTOMATED FEED SYSTEM FOR PIPE MAKING MACHINE

BACKGROUND OF THE INVENTION

This invention relates to machines for producing concrete pipe and other precast products such as manholes and manhole risers, which products are produced in a variety of shapes including round, rectangular and elliptical.

There are machines of a variety of designs for producing concrete pipe and other similar products in which a form is filled at a filling station with concrete supplied to the form by a concrete feeder. An example of machines of this type is shown in Schmidgall et al U.S. Pat. No. 4,708,621 entitled "Concrete Pipe Making Machine". The machine shown in this patent uses the dry cast method in which a dry concrete mix is compacted in the form and the mold is removed immediately before the concrete is set Typically, machines using the dry cast method employ three cycles in which the basic functions of filling, pressure-heading and stripping are performed. In the conventional multiple station machine, a module for each station is secured to a turntable with a jacket and core forming the mold to be filled with concrete at the filling station. The turntable is then rotated to the pressure-heading station where the concrete is compacted in the form. At the third station, the jacket with the now-formed concrete pipe is stripped from the core and moved to a curing area where the jacket is lifted from the now-formed pipe.

At the filling station, the concrete is typically fed into the top of the forms by a conveyor that moves the concrete from a storage hopper down through a chute which is moved into position over a feed pan on top of the form. There are a variety of methods for distributing the concrete from the feed pan into the form.

In other pipe making machines, especially those for producing large diameter pipe, a turntable is not used, and therefore the forms are in a fixed position and the filling, pressure-heading and stripping operations must be carried out by moving the equipment for each of these operations over the stationery form. Thus, the concrete feeder must be moved in position over the form and then moved out of position so that the pressure-heading and stripping operations can take place. One of the standard concrete feeders consists of a hopper supported over a pivot with a radial-drive structure that powers the concrete feeder so that it will rotate about the pivot With this arrangement, the lower end of the conveyor is located at the pivot beneath the hopper to receive the concrete and the discharge end of the conveyor is swung over the form to be filled with the concrete being distributed by a rotating chute which distributes the concrete in a circular path. This system works quite well for round concrete pipe since the chute can be centered over the form and angled to discharge the concrete into the form as the chute revolves. However, where elliptical, box or other non-circular shapes are to be produced, the conveyor belt and discharge chute must be manually manipulated into the proper position so that the chute is located accurately with respect to the wall cavity of the non-circular form.

There are other known types of feeders in which the hopper is mounted over a pivot and the discharge end of the conveyor can be moved in guides closer to or farther from the pivot point Therefore, by pivoting the conveyor and moving the discharge end either inwardly or outwardly, the concrete can be discharged at any given point Feeders of this type do not utilize a chute but commonly use a power distributor on top of the core to distribute the concrete into the wall cavity of the form. Yet another type of known feeder is to position the conveyor beneath a hopper over a pivot point and to provide a distributor belt at the discharge end of the conveyor which distributor belt can be rotated to distribute the concrete in a circular path. In this type of feeder, the distributor belt is used rather than a revolving chute. Although this type of feeder can be used to fill non-round shapes by adjusting the position and length of the distributor belt, the feeder is manually controlled.

Recently, yet another type of feeder has become known and commercially available. This feeder consists of a hopper, a conveyor belt, and a positioning track that permits the entire feeder, including the hopper and conveyor belt, to move sideways along a track. The conveyor belt can be extended or retracted along a line perpendicular to the track so that the discharge end of the conveyor will operate as an X-Y feeder. Because of the movement of the feeder along both X and Y axes, this type of feeder works quite well for filling box shapes manually. For other non-round shapes as elliptical or arch, it is much more difficult to fill the forms because the X and Y paths need to be controlled simultaneously by the operator. Moreover, these feeders normally do not employ a chute and therefore must be equipped with a distributor blade or other means to direct the concrete into the wall cavities of the form. Also, with the X-Y feeder, the hopper is not stationery which requires that the feeder be returned to a common point before it can be charged with additional concrete. When filling large forms, it may be necessary to charge the hopper several times for each pipe mold which interrupts the filling operation.

There is therefore a need for an improved feeder for concrete pipe making machine which can more quickly, accurately and efficiently fill forms of all sizes and types, including round, box-shaped, elliptical and arch. Such a feeder must be relatively simple for the operator to operate and preferably is adaptable to the designs of existing machines.

SUMMARY OF THE INVENTION

The automated feeder of the invention consists of a concrete storage hopper mounted over a pivot and which charges the concrete onto a belt-type conveyor the input end of which conveyor turns on the same pivot The discharge end of the feeder conveyor discharges the concrete into a rotatable chute that distributes the concrete to the cavity in the pipe mold. Sensors and encoders are combined with the feeder conveyor and the chute to provide information regarding the radial speed and position of the conveyor and the speed and position of the chute at all times. Information from the sensors and encoders is inputted into a computer which controls the speed and position of the components of the automated feeder depending upon the selected size and shape of the form to be filled.

BRIEF DESCRIPTION OF THE DRAWINGS

FIG. 6 is a side elevational view of the radial drive for the feeder;

FIG. 7 is a bottom view of the radial drive of FIG. 6;

FIG. 8 is a front elevational view of the drive of FIGS. 6 and 7;

FIG. 12 is a bottom view of the lower portion of the turnhead to which the chute is mounted;

FIG. 13 is an enlarged view of a portion of the turnhead and showing the encoder mounted on the turnhead;

FIG. 14 is a front elevational view of the lower portion of the turnhead showing the mounting of the encoder.

DESCRIPTION OF THE PREFERRED EMBODIMENT OF THE INVENTION

Figure 1:
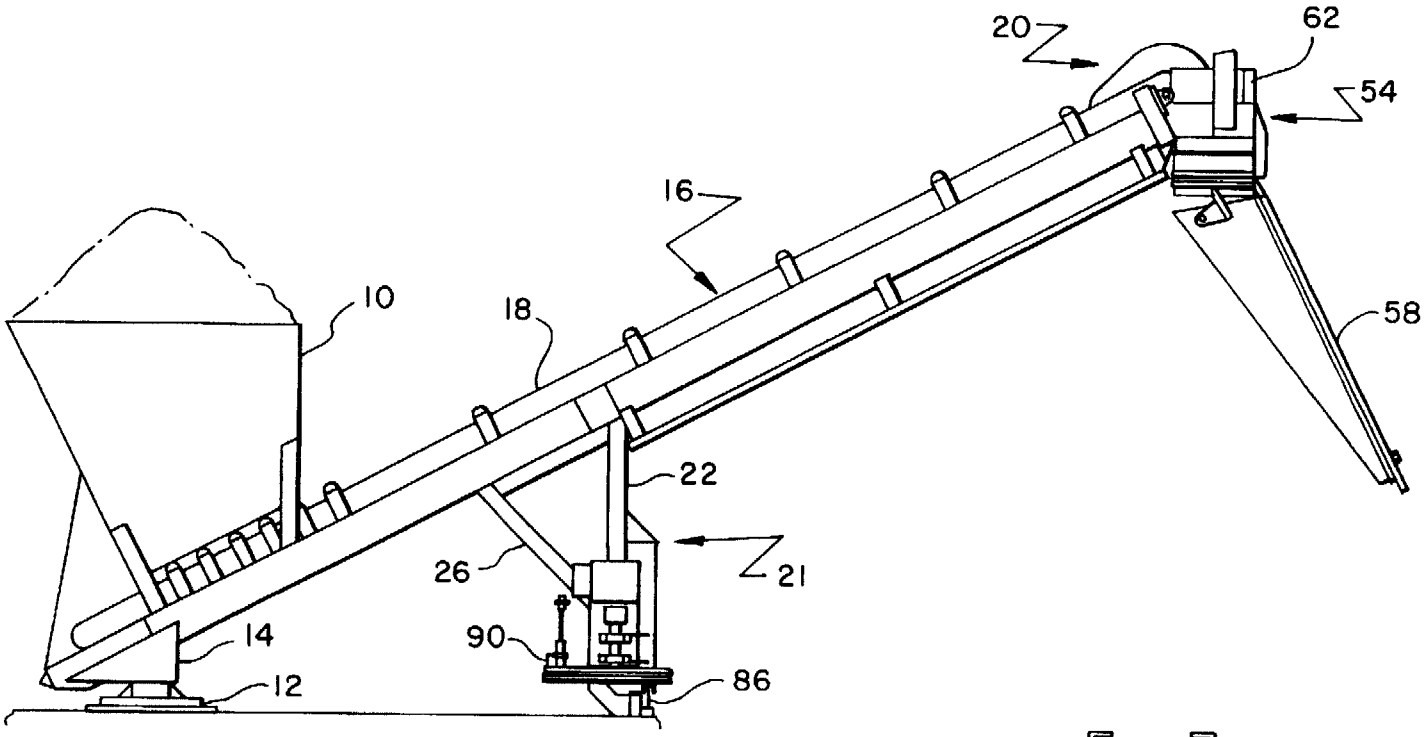
FIG. 1 is a side elevational view of the feeder of the invention.

The automated feed system of the invention forms a part of a concrete pipe making machine of the general type disclosed in Schmidgall et al U.S. Pat. No. 4,708,621. The automated feed system comprises the fill station of the pipe making machine at which station the concrete is moved from a hopper 10 and directed into the form set (not shown) for the particular pipe being produced. In the automated feed system of the invention, the hopper 10 is mounted on a base 12 which provides a pivot support 14 about which the hopper 10 moves. This is important because as the hopper 10 empties, concrete can be charged into the hopper 10 from a common source without moving the hopper or feeder to the source of the concrete. Also mounted on the base 12 is the lower end of a conveyor 16 having a belt 18 to move concrete from the hopper 10 to the discharge end 20 of the conveyor. The hopper 10 and lower end of the conveyor 16 thus pivot as a unit about the pivot support 14.

The conveyor 16 is supported and carried near its center by a feeder carriage indicated generally by the reference numeral 21. The carriage 21 includes angular supports 22 the lower ends of which are connected to a horizontal cross beam 24. Angular braces 26 provide additional rigidity to the conveyor support A pair of wheels 28 are mounted beneath the cross beam 24 and are engageable in a radial track 30 the center of curvature of which is the pivot support 14.

Figure 2:
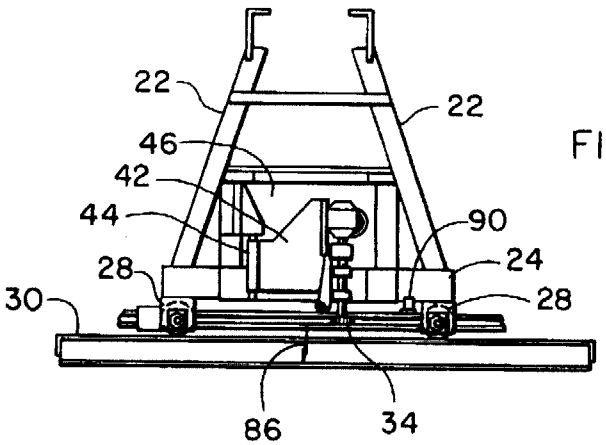
FIG. 2 is a front elevational view of the radial drive and support structure of the feeder.
Figure 5:
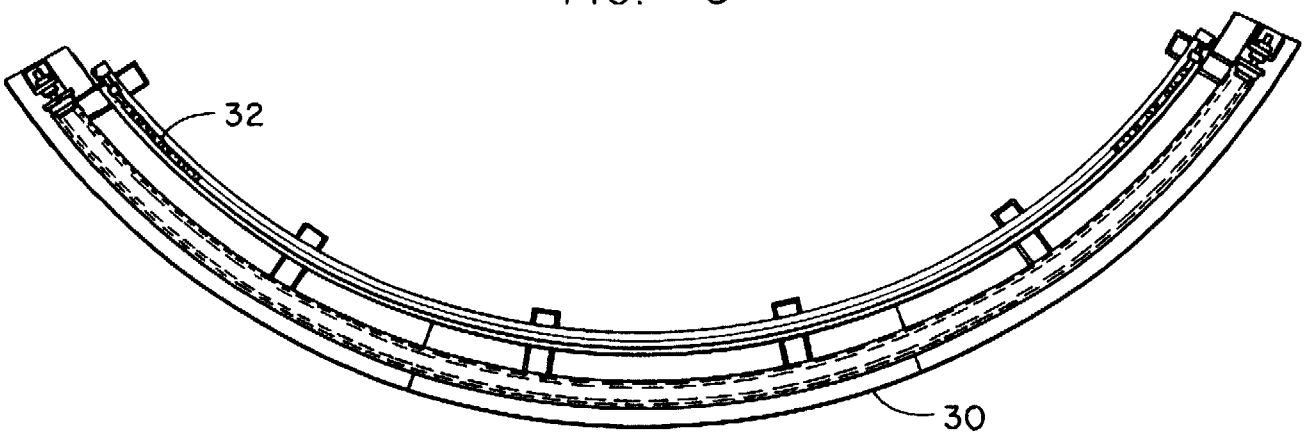
FIG. 5 is a top elevational view of the radial track for the feeder carriage.
Figure 4:
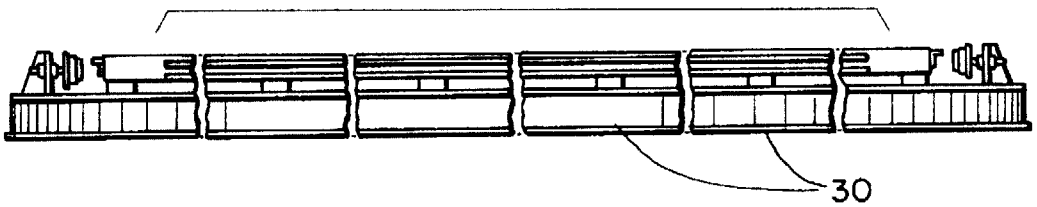
FIG. 4 is a front elevational view of the radial track for the feeder carriage.
Figure 10:
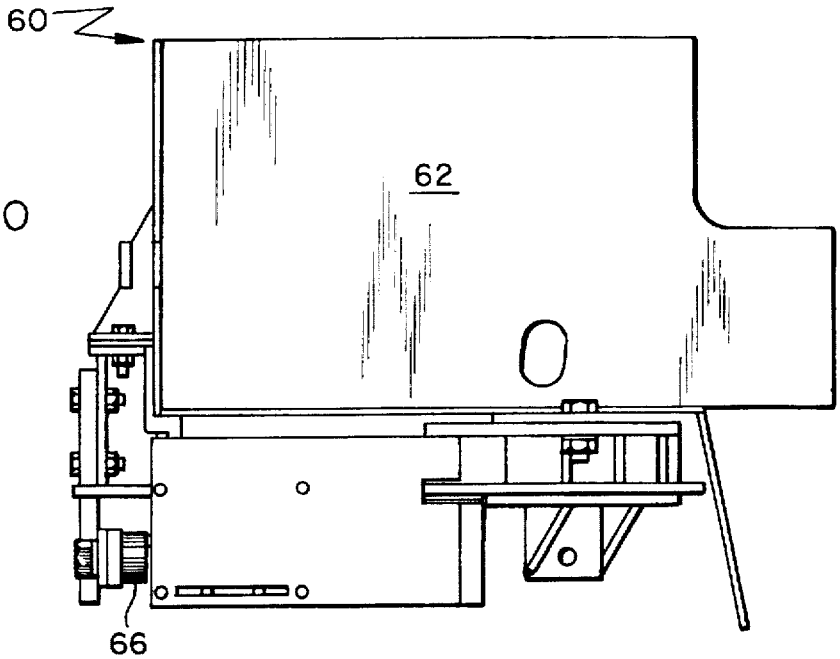
FIG. 10 is a side elevational view of the upper portion of the turnhead of FIG. 9.

In order to move the feeder along the track 30, a chain 32 is mounted inside of the track 30 (FIG. 5), the chain 32 being engaged by a sprocket 34 (FIGS. 6 and 8) secured to a vertical shaft 36 that is mounted by bearings 38 to a mounting plate 40 that forms a part of a vertically extending support 42 pivotly mounted on pivot 44 that is secured by support plate 46 to the cross beam 24 and angular supports 22 (FIG. 2). The shaft 36 and sprocket 34 are driven by an electric or hydraulic motor 50. If an electric motor is used, a gear reducer 48 is employed to drive shaft 36. A pair of cam followers 52 (FIGS. 6 and 7) ensure engagement of the sprocket 34 with the chain 32. Thus, when the motor 50 is operating, sprocket 34 will be driven, and engagement of sprocket 34 with chain 32 will move the feeder carriage 21 along the radial track 30.

As best seen in FIG. 1, at the discharge end 20 of conveyor 16 there is mounted a concrete distributor means indicated generally by the reference numeral 54. The concrete distributor means 54 receives the concrete carried by the belt 18 of conveyor 16 when it is discharged from the end 20 of the conveyor 16. The concrete thus discharged passes into an annular shaped guide 56 and then into a distributor chute 58. The angular setting of the chute 58 is manually set to the desired slope, but once the slope is set, speed and position of the chute 58 is controlled in the manner described hereinafter.

As best seen in FIGS. 9–12, the annular guide 56 forms the stationery and upper portion of the distribution means 54. The annular guide 56 is mounted within a rectangular enclosure 60 the side plates 62 of which are secured to the discharge end 20 of the conveyor 16. The rectangular enclosure 60 has secured to its bottom edge an annular plate 64 which supports a plurality of cam followers 66 mounted for rotation about a horizontal axis. Annular plate 64 also supports a plurality of cam followers 68 each of which is mounted for rotation about a vertical axis. These cam followers 66 and 68 support and guide the rotatable turnhead indicated generally by the reference numeral 70 (FIG. 14). The turnhead 70 has an upper outwardly extending flange 72 which engages the cam followers 66 and 68 which in turn support the turnhead 70 for rotational movement The discharge chute 58 is connected by brackets 71 to the lower end of the turnhead 70 so that it rotates with the turnhead 70.

Figures 3, 9:
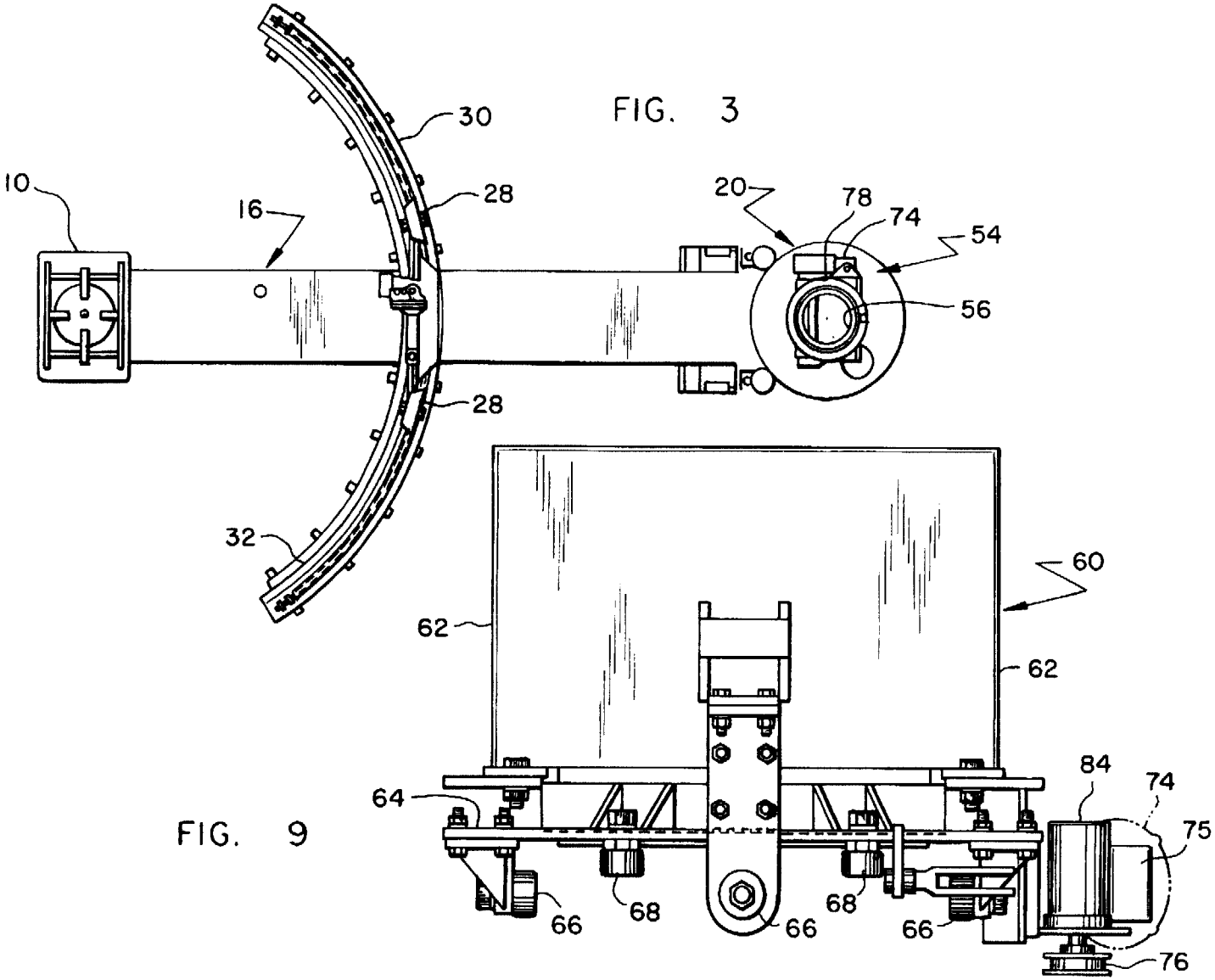
FIG. 3 is a top or plan view of the feeder of FIG. 1 with the hopper removed and details of the belt conveyor not shown.
FIG. 9 is a front elevational view of the upper portion of the turnhead mounted to the discharge end of the conveyor.
Figure 11:
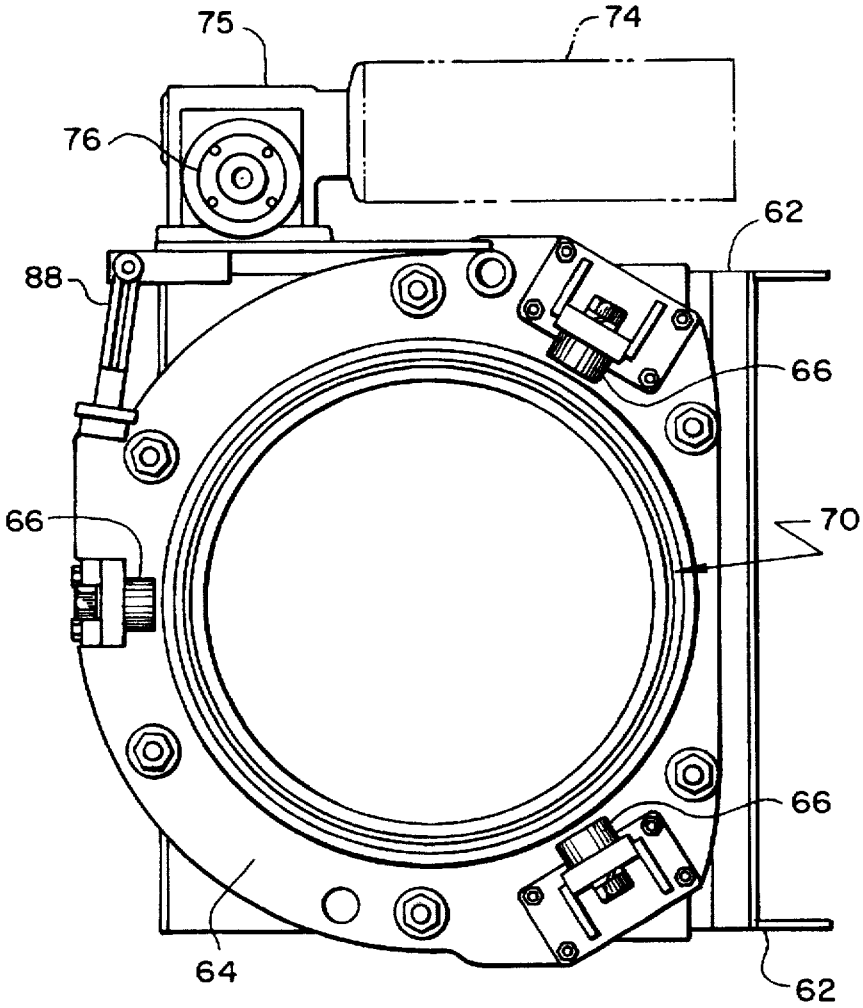
FIG. 11 is a top view of the turnhead.

The turnhead 70 is driven by an electric motor 74 (dotted lines in FIG. 11) that through a gear reducer 75 drives a pulley 76 connected to a drive belt 78 (FIG. 3) that wraps around the turnhead 70 and is engaged between and guided by two outwardly extending flanges 80 and 82 (FIG. 14). Instead of the pulley-drive belt arrangement, a sprocket and roller chain may be used, and in either case, the drive may be powered by the electric motor 74 or a hydraulic motor 84. In FIG. 9, both a hydraulic motor 84 and an electric motor 74 have been shown for purpose of illustration. Motor 74 or 84 is mounted on the outside of one of the side plates 62 as best seen in FIGS. 9 and 11. An adjustment 88 provides for adjusting the tension on the drive belt 78.

In order to have the capability of automatically filling forms of a variety of shapes, the position and speed of the discharge chute 58 and the position and speed of the radial movement of the feeder carriage 21 that supports the conveyor 16 must be controlled. Encoders are therefore used to constantly monitor the speed and position of these components. If electric motors 74 and 50 are used, the encoders will be built into the motors. However, if hydraulic motor 84 is used and motor 50 is hydraulic, encoders that are separate components must be used. There is shown in the drawings (FIGS. 1 and 2) an encoder 90 that is mounted at the bottom of the cross beam 24, the encoder 90 having an encoder wheel (not shown) which travels along the radial track 30 and provides a signal from which the speed and position of the carriage 21 along the track 30 can be determined. If motor 74 driving the distribution means 54 is hydraulic, an encoder 92 is mounted on the stationery annular plate 64, and an encoder wheel 94 is connected to encoder 92 to monitor movement and position of the distribution means 54.

The use of electrical motors provides quicker response time and eliminates the need of a separate encoder and encoder wheel, but electric motors require a gear reducer. If hydraulic motor 84 is used to drive the distribution means 54, the encoder 92 is mounted on an arm 96 pivotly attached to the annular plate 64 and is biased by a spring (not shown) so that the encoder wheel 94 engages the flange 80 of the turnhead 70. Thus, as the turnhead 70 rotates, encoder 92 will monitor the speed and position of the turnhead 70 and thus the speed and position of the discharge chute 58. With the feeder of the invention, the exact position and speed of the discharge chute 58 therefore can be determined at all times. The information supplied by encoders 92 and 90 is used to control movement of the discharge chute 58, movement of the turnhead 70 and movement of the feeder carriage 21 along the radial track 30.

In order to return the components to a starting position from which the encoders 90 and 92 can properly function to measure the speed and position of the components, there is preferably provided a homing sensor 86 (FIGS. 1 and 2) mounted on track 30 so as to engage a trigger (not shown) the radial carriage 21. When the motor 74 or 84 is first started to begin a filling operation, the carriage 21 will travel along track 30 until the sensor 86 is engaged.

This will provide a signal that the carriage 21 is in a "home" position from which the encoder 90 can now measure the position of the carriage 21. A similar arrangement is also provided for the distribution means 54 to "home" the position of the turnhead 70.

Figure 15:
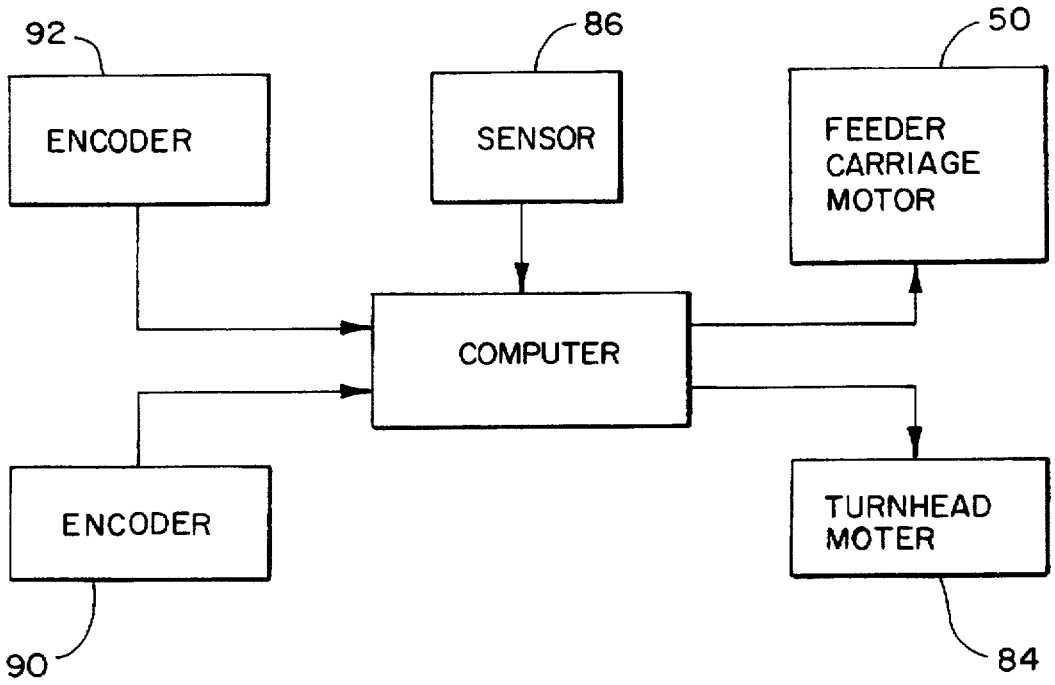
FIG. 15 is a schematic diagram of the control system of the feeder.

The basic control system for the feeder of the invention is illustrated in the schematic diagram of FIG. 15. With this control system, a concrete form of any configuration can be filled. The system can be preprogrammed to fill forms of a variety of sizes by controlling the speed and position of the distributor chute 58, movement and location of the feeder carriage 21 along the radial track 30 and the speed of the conveyor belt 18. Operator controls and computer programs for utilizing the information provided by the encoders 90 and 92 of the invention are within the skill of persons skilled in the art, and will depend upon the particular applications for the automated feeder of the invention, the types and sizes of forms to be filled, etc. However, in any event, it is evident that the automated feeder of the invention permits full automation of the filling process for forms of any size or shape.

As previously indicated, the drawings show a hydraulic system using separate encoders, but variable speed electric motors having built-in encoders may also be used for driving the feeder carriage 21 and the turnhead 70, and in some applications the latter may be preferred because of quicker response. By positioning the concrete hopper 10 above the pivot support 14 for the conveyor 16 and feeder carriage 21, the problem of having to stop the operation to move the hopper 10 into a position to be refilled is eliminated. The automated feeder of the invention provides more accurate control and thus more even layers of concrete as the form is filled and improves the quality of the product By being fully automated, the operator is free to do other tasks during the filling operation. The tracking speed of the distributor chute 58 is variable depending upon the product shape to be filled, and the speed can be adjusted to be at a slower or faster rate along different areas of the form being filled. The automated feeder of the invention could be modified so that the concrete is discharged directly onto a feed pan and then distributed. A typical type of feed pan is shown in Schmidgall et al U.S. Pat. No. 4,708,621. Other types of feed pans are also used and well known. However, use of the concrete distributor chute 58 provides an easier method of filling circular shapes of forms which are the most common shape for concrete pipe. When filling circular forms, the feeder can be pivoted to the center of the form and the chute 58 rotated in a circular path at a constant speed.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. An automated concrete feeder for use with concrete pipe making machines used to produce concrete pipes that have round as well as box-shaped, elliptical and other non-round shapes, the feeder comprising: a concrete storage hopper mounted over a fixed pivot, a feeder conveyor having an input end and a discharge end at a level above the input end, the conveyor being supported with the input end of the conveyor positioned beneath the hopper and turnable on substantially the same fixed pivot as the hopper for swinging movement of the conveyor along a radial path, the concrete being charged from the hopper onto the input end of the conveyor, a rotatable chute mounted on the discharge end of the conveyor and moveable in a circular path, the chute being also swingable with the feeder conveyor as the feeder conveyor moves along its radial path, the chute receiving concrete discharged by the conveyor and distributing the concrete into the mold cavity of the pipe to be formed, a first power means to drive the feeder conveyor along the radial path, a second power means to drive the rotatable chute in a circular path, a first encoder combined with the first power means to monitor the position of the feeder conveyor along the radial path and the speed of movement of the feeder conveyor along said radial path, and a second encoder combined with the rotatable chute to monitor the position and speed of the chute along its circular path, the information from the first and second encoders being inputted into a computer which controls the first and second power means to thereby control the speed and position of the feeder conveyor and the chute depending upon the selected size and shape of the concrete form to be filled.

2. The automated concrete feeder of claim 1 in which there is a feeder carriage supporting the feeder conveyor between the input end and the discharge end of the conveyor, and a radial track is provided upon which the feeder carriage moves, the first power means driving the feeder carriage along the track with the first encoder monitoring the speed and position of the feeder carriage along the track.

3. The automated concrete feeder of claim 2 in which there is an upper turnhead fixed to the discharge end of the feeder conveyor and a lower turnhead rotatable relative to the upper turnhead, the second power means driving the lower turnnhead, and the chute being mounted to the lower turnhead for rotatable movement with the lower turnhead along the circular path, the second encoder thereby monitoring the position and speed of the chute in its circular path.

4. The automated concrete feeder of claim 3 in which the chute is adjustably mounted to the lower turnhead so that the angle of the chute relative to the turnhead can be selected and the chute fixed in a selected position.

5. The automated concrete feeder of claim 4 in which homing sensors are combined with the feeder carriage and track and with the upper and lower turnheads to provide signals to the computer when the feeder carriage and lower turnhead are in preselected home positions.

6. The automated concrete feeder of claim 5 in which the first and second power means are each hydraulic motors, the first motor being mounted on the feeder carriage and the second motor being mounted on the upper turnhead, the first encoder includes an encoder wheel engageable with the track and the second encoder includes an encoder wheel engageable with the lower turnhead.

7. The automated concrete feeder of claim 5 in which the first and second power means are each electric motors, and the first and second encoders form a part of the first and second motors, respectively.

* * * * *